US009905349B2

(12) United States Patent
Park et al.

(10) Patent No.: US 9,905,349 B2
(45) Date of Patent: Feb. 27, 2018

(54) CHIP ELECTRONIC COMPONENT

(71) Applicant: SAMSUNG ELECTRO-MECHANICS CO., LTD., Suwon-Si, Gyeonggi-Do (KR)

(72) Inventors: Moon Soo Park, Suwon-Si (KR); Jong Ho Lee, Suwon-Si (KR); Dong Hwan Lee, Suwon-Si (KR); Jin Ok Han, Suwon-Si (KR); Tae Young Kim, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 159 days.

(21) Appl. No.: 14/692,696

(22) Filed: Apr. 21, 2015

(65) Prior Publication Data

US 2016/0042859 A1 Feb. 11, 2016

(30) Foreign Application Priority Data

Aug. 11, 2014 (KR) ..... 10-2014-0103945

(51) Int. Cl.

| | |
|---|---|
| ***H01F 27/02*** | (2006.01) |
| ***H01F 17/04*** | (2006.01) |
| ***H01F 17/00*** | (2006.01) |
| *H01F 3/10* | (2006.01) |

(52) U.S. Cl.

CPC ..... *H01F 17/04* (2013.01); *H01F 17/0013* (2013.01); *H01F 27/02* (2013.01); *H01F 2003/106* (2013.01); *H01F 2017/048* (2013.01)

(58) Field of Classification Search

CPC ..... H01F 27/00–27/36

USPC ..... 336/65, 83, 200, 232

See application file for complete search history.

(56) References Cited

U.S. PATENT DOCUMENTS 6,246,172 B1 * 6/2001 Bizen ..... H01F 41/0226 315/5.41
6,392,525 B1 * 5/2002 Kato ..... H01F 3/08 336/200
7,449,984 B2 * 11/2008 Kawarai ..... H01F 17/043 336/83

(Continued)

FOREIGN PATENT DOCUMENTS

CN 103714961 A 4/2014
JP 2002-305108 A 10/2002

(Continued)

OTHER PUBLICATIONS

Notice of Office Action issued in corresponding Korean Patent Application No. 10-2014-0103945, dated Jun. 4, 2015; 16 pages with English translation.

(Continued)

*Primary Examiner* — Tuyen Nguyen
(74) *Attorney, Agent, or Firm* — McDermott Will & Emery LLP

(57) ABSTRACT

There is provided a chip electronic component including: a magnetic body having an internal coil part embedded therein, wherein the magnetic body includes: a central portion provided inside of the internal coil part and including a core; and an outer peripheral portion provided outside of the central portion, the central portion and the outer peripheral portion having different magnetic permeabilities.

10 Claims, 4 Drawing Sheets

(56) References Cited

U.S. PATENT DOCUMENTS

| | | | | |
|---|---|---|---|---|
| 7,523,542 | B2 | 4/2009 | Kawarai | |
| 8,610,525 | B2 * | 12/2013 | Matsuura | H01F 17/0013 336/200 |
| 2002/0097124 | A1 | 7/2002 | Inoue et al. | |
| 2013/0127576 | A1 | 5/2013 | Hachiya et al. | |
| 2013/0249662 | A1 | 9/2013 | Tonoyama et al. | |
| 2014/0077914 | A1 * | 3/2014 | Ohkubo | H01F 5/00 336/177 |

FOREIGN PATENT DOCUMENTS

| | | | |
|---|---|---|---|
| JP | 2007-067214 | A | 3/2007 |
| JP | 2008-166455 | A | 7/2008 |
| JP | 2009-049335 | A | 3/2009 |
| JP | 2013-201374 | A | 10/2013 |
| JP | 2014-090158 | A | 5/2014 |

OTHER PUBLICATIONS

The First Office Action issued in counterpart Chinese Patent Application No. 201510228124.X, dated Aug. 31, 2017, with English translation.

* cited by examiner

CHIP ELECTRONIC COMPONENT

CROSS-REFERENCE TO RELATED APPLICATION

This application claims the priority and benefit of Korean Patent Application No. 10-2014-0103945 filed on Aug. 11, 2014, with the Korean Intellectual Property Office, the disclosure of which is incorporated herein by reference.

BACKGROUND

The present disclosure relates to a chip electronic component.

An inductor, a chip electronic component, is a representative passive element configuring an electronic circuit together with a resistor and a capacitor to remove noise therefrom.

A thin film type inductor is manufactured by forming internal coil parts and then hardening a magnetic powder-resin composite in which magnetic powder particles are mixed with a resin.

RELATED ART DOCUMENT (Patent Document 1) Japanese Patent Laid-Open Publication No. 2008-166455

SUMMARY

An aspect of the present disclosure may provide a chip electronic component having improved inductance and quality (Q) factor.

According to an aspect of the present disclosure, a chip electronic component may include: a magnetic body having an internal coil part embedded therein, wherein the magnetic body includes first and second magnetic parts having different magnetic permeabilities.

The magnetic body may include: a central portion provided inside of the internal coil part and including a core; and an outer peripheral portion provided outside of the central portion, the central portion and the outer peripheral portion having different magnetic permeabilities.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
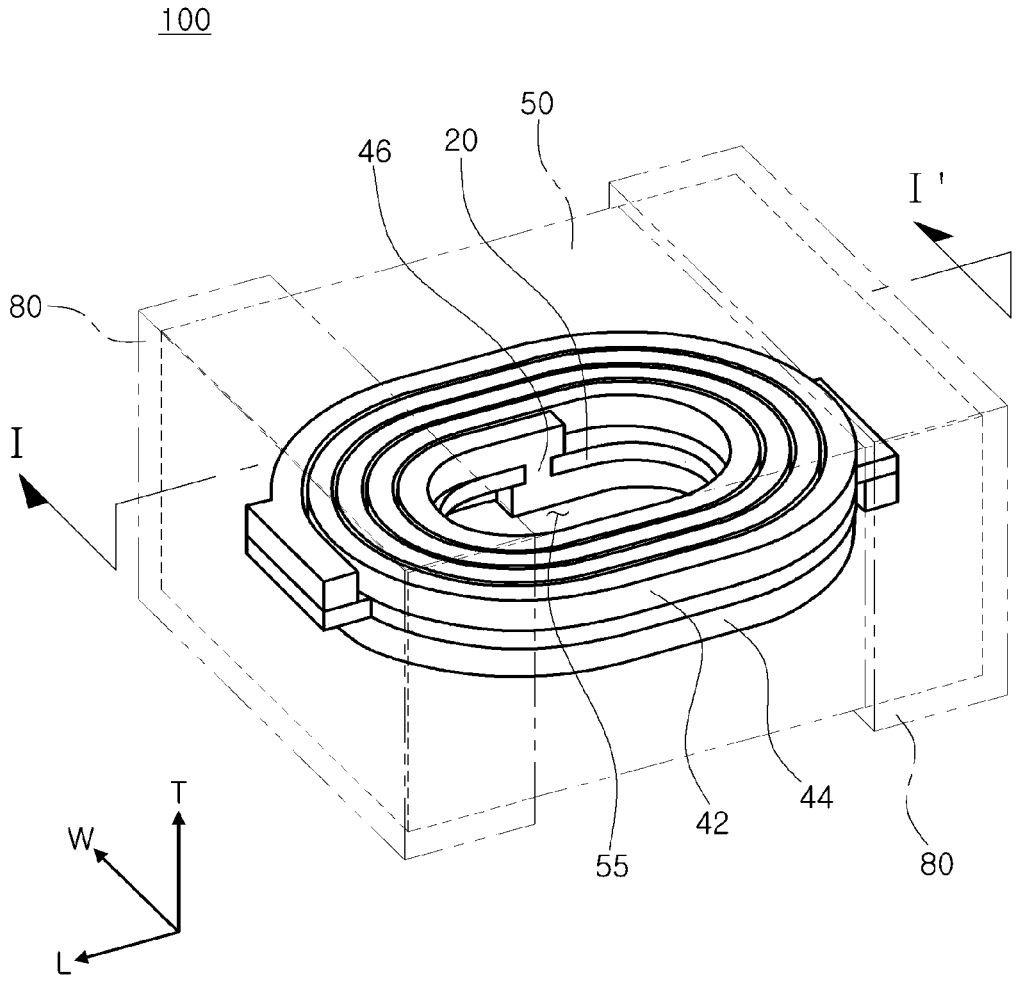
FIG. 1 is a schematic perspective view of a chip electronic component including internal coil parts according to an exemplary embodiment of the present disclosure.

Exemplary embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment of the present disclosure, particularly, a thin film type inductor will be described. However, the present inventive concept is not necessarily limited thereto.

FIG. 1 is a schematic perspective view of a chip electronic component including internal coil parts according to an exemplary embodiment of the present disclosure.

Referring to FIG. 1, a thin film type inductor 100 used in a power line of a power supply circuit is disclosed as an example of the chip electronic component.

The chip electronic component 100 according to an exemplary embodiment of the present disclosure may include a magnetic body 50, internal coil parts 42 and 44 embedded in the magnetic body 50, and external electrodes 80 disposed on outer surfaces of the magnetic body 50 and electrically connected to the internal coil parts 42 and 44.

In the chip electronic component 100 according to an exemplary embodiment of the present disclosure, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may form the exterior appearance of the thin film type inductor 100 and contain, for example, ferrite or magnetic metal particles, but is not necessarily limited thereto. That is, the magnetic body 50 may contain any material having magnetic properties.

The magnetic metal particles may be formed of an alloy containing at least one selected from the group consisting of Fe, Si, Cr, Al, and Ni. For example, the magnetic metal particles may contain Fe—Si—B—Cr based amorphous metal particles, but are not limited thereto.

The magnetic metal particles may be contained in a polymer such as an epoxy resin, polyimide, or the like, in a form in which they are dispersed in the polymer.

An insulating substrate 20 disposed in the magnetic body 50 may be, for example, a polypropylene glycol (PPG) substrate, a ferrite substrate, a metal based soft magnetic substrate, or the like.

The insulating substrate 20 may have a through-hole formed to penetrate through a central portion thereof, wherein the through-hole may be filled with magnetic materials such as ferrite, magnetic metal particles, or the like, to form a core 55. The core 55 filled with the magnetic materials may be formed, thereby improving an inductance (Ls).

The insulating substrate 20 may have the internal coil parts 42 and 44 formed on one surface and the other surface thereof, respectively, wherein the internal coil parts 42 and 44 have coil shaped patterns.

The internal coil parts 42 and 44 may include coil patterns having a spiral shape, and the internal coil parts 42 and 44 formed on one surface and the other surface of the insulating substrate 20, respectively, may be electrically connected to each other through a via electrode 46 formed in the insulating substrate 20.

The internal coil parts 42 and 44 and the via electrode 46 may be formed of a metal having excellent electrical conductivity, for example, silver (Ag), palladium (Pd), aluminum (Al), nickel (Ni), titanium (Ti), gold (Au), copper (Cu), platinum (Pt), or an alloy thereof, etc.

One end portion of the internal coil part 42 formed on one surface of the insulating substrate 20 may be exposed to one end surface of the magnetic body 50 in a length direction thereof, and one end portion of the internal coil part 44 formed on the other surface of the insulating substrate 20 may be exposed to the other end surface of the magnetic body 50 in the length direction thereof.

The external electrodes 80 may be formed on both end surfaces of the magnetic body 50 in the length direction thereof, respectively, to be connected to the internal coil parts 42 and 44 exposed to both end surfaces of the magnetic body 50 in the length direction thereof, respectively.

The external electrodes 80 may be formed of a metal having excellent electrical conductivity, for example, nickel (Ni), copper (Cu), tin (Sn), silver (Ag), or an alloy thereof, etc.

Figure 2:
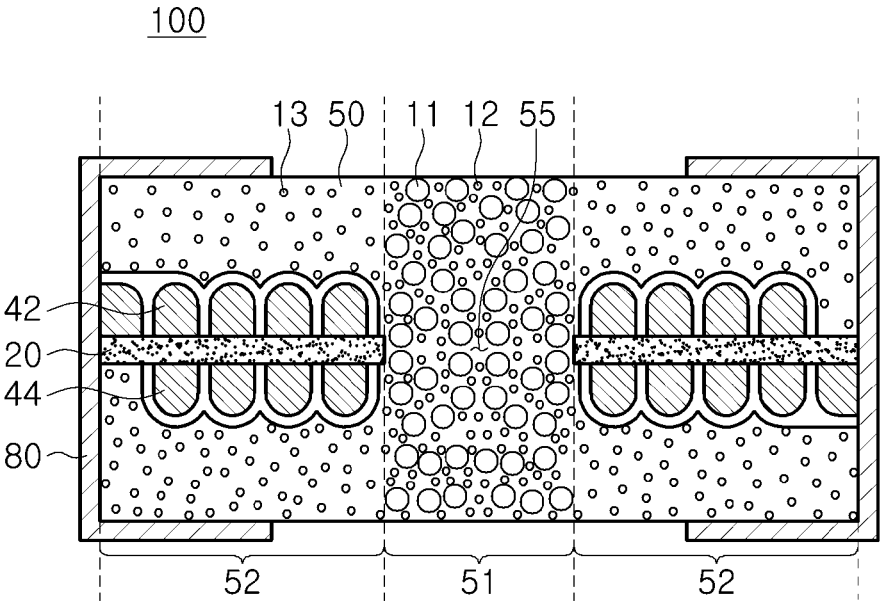
FIG. 2 is a cross-sectional view taken along line I-I' of FIG. 1.
Figure 3:
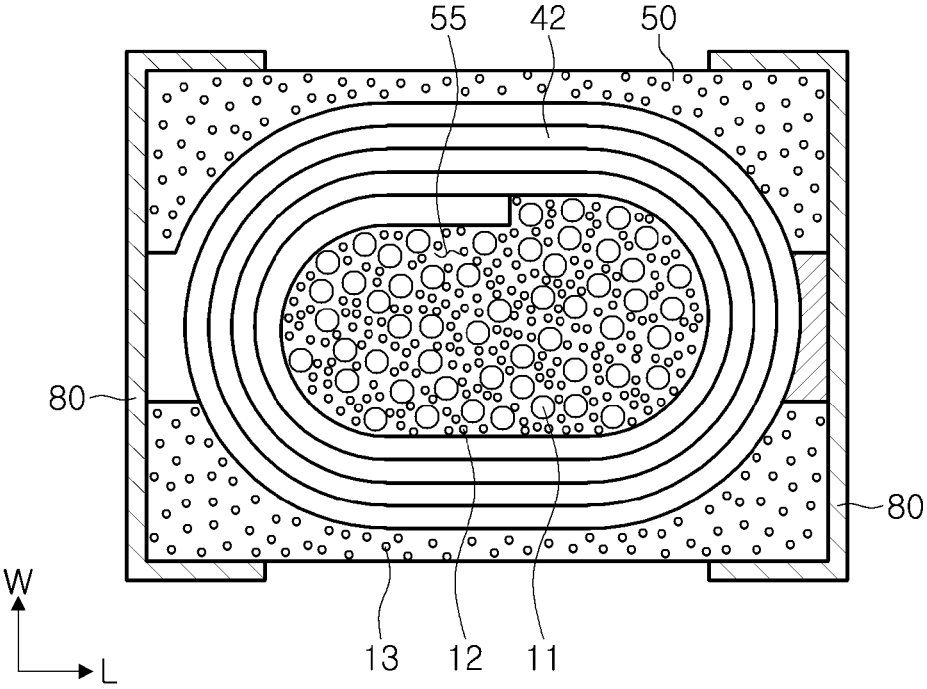
FIG. 3 is a cross-sectional view of the chip electronic component of FIG. 1 taken in an LW direction, according to an exemplary embodiment of the present disclosure.

FIG. 2 is a cross-sectional view taken along line I-I' of FIG. 1; and FIG. 3 is a cross-sectional view of the chip electronic component of FIG. 1 taken in an LW direction according to an exemplary embodiment of the present disclosure.

Referring to FIGS. 2 and 3, the magnetic body 50 according to an exemplary embodiment of the present disclosure may contain magnetic metal particles 11 to 13 and may be divided into first and second magnetic parts having different magnetic permeabilities.

The magnetic body 50 may include a central portion 51 provided inside of the internal coil parts 42 and 44 and including the core 55 and an outer peripheral portion 52 provided outside of the central portion 51, wherein the central portion 51 is provided with a first magnetic part and the outer peripheral portion is provided with a second magnetic part having a magnetic permeability different from that of the first magnetic part.

Magnetic permeabilities of the first and second magnetic parts may be adjusted to be different from each other by making packing factors of the magnetic metal particles 11 to 13 different from each other. However, the present inventive concept is not necessarily limited thereto. That is, any method for adjusting the magnetic permeabilities to be different from each other may be used.

For example, a difference between the magnetic permeabilities of the first and second magnetic parts may be 10 H/m to 40 H/m.

According to an exemplary embodiment of the present disclosure, a magnetic permeability of the first magnetic part may be higher than that of the second magnetic part, and the first magnetic part may be provided in the central portion 51 and the second magnetic part may be provided in the outer peripheral portion 52, such that a magnetic permeability of the central portion 51 may be higher than that of the outer peripheral portion 52.

As shown in FIGS. 2 and 3, the central portion 51 having a relatively high magnetic permeability may contain mixtures of first magnetic metal particles 11, which are coarse powder particles, and second magnetic metal particles 12, which are fine powder particles, having an average particle size smaller than that of the first magnetic metal particles 11.

The first magnetic metal particles 11 having a large average particle size may have high magnetic permeability, and the first magnetic metal particles 11, which are the coarse powder particles, and the second magnetic metal particles 12, which are the fine powder particles, may be mixed with each other to improve packing factors, thereby further improving a magnetic permeability and improving a quality (Q) factor.

The outer peripheral portion 52 having a relatively low magnetic permeability may contain third magnetic metal particles 13, which are fine powder particles.

Since the third magnetic metal particles 13, which are the fine powder particles, contained in the outer peripheral portion 52 show low magnetic permeability, but are low loss materials, they may serve to complement core loss increased due to use of high magnetic permeability materials in the central portion 51.

That is, the high magnetic permeability materials may be used in the central portion 51 on which a magnetic flux is concentrated, and the increase in the core loss due to the high magnetic permeability materials may be alleviated by using the low loss materials in the outer peripheral portion 52. Therefore, an inductance and a Q factor may be improved.

Further, in the case of using the third magnetic metal particles 13, which are the fine powder particles, a surface roughness of the magnetic body 50 maybe improved, and a plating spreading phenomenon due to the fine powder particles may be prevented.

In the case of using magnetic metal particles, which are coarse powder particles, in order to achieve high magnetic permeability, a defect that the magnetic metal particles, which are the coarse powder particles, are exposed on the surface of the magnetic body 50 and a plating layer is formed on the exposed portion of the magnetic metal particles, which are the coarse powder particles, in a plating process of forming the external electrodes may occur.

However, in an exemplary embodiment of the present disclosure, the central portion 51 contains the first magnetic metal particles 11, which are the coarse powder particles, in order to achieve high magnetic permeability, and the outer peripheral portion 52 contains the third magnetic metal particles 13, which are the fine powder particles, whereby a magnetic permeability may be improved and a plating spreading defect may be suppressed.

A particle size of the first magnetic metal particles 11, which are the coarse powder particles, in the central portion 51 may be 11 μm to 53 μm, and a particle size of the second magnetic metal particles 12, which are the fine powder particles, in the central portion 51 may be 0.5 μm to 6 μm.

A packing factor of the magnetic metal particles in the central portion 51 may be 70 to 85%.

A magnetic permeability of the central portion 51 may be 28 H/m to 45 H/m.

A particle size of the third magnetic metal particles 13, which are the fine powder particles, in the outer peripheral portion 52 may be 0.5 μm to 6 μm.

A packing factor of the magnetic metal particles in the outer peripheral portion 52 may be 55 to 70%.

A magnetic permeability of the outer peripheral portion 52 may be 10 H/m to 30 H/m.

Figure 4:
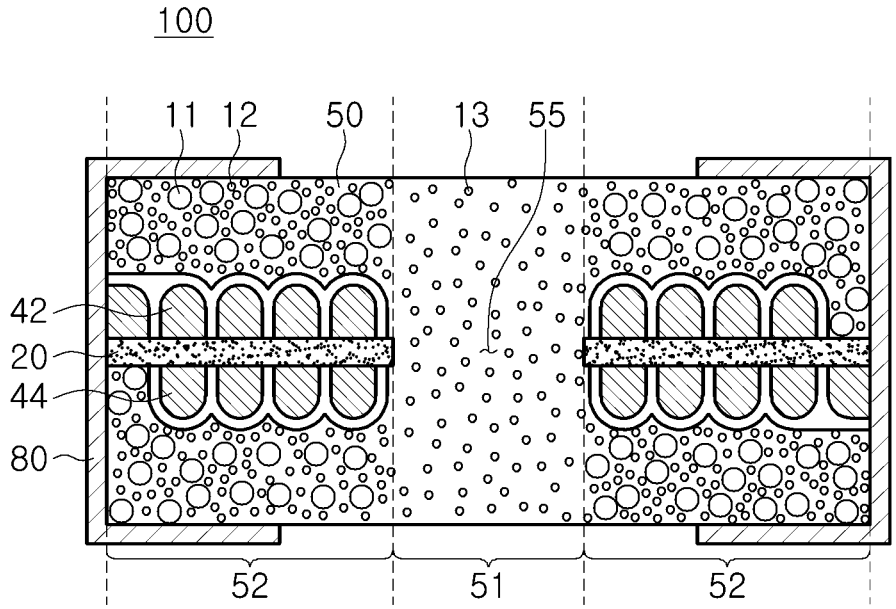
FIG. 4 is a cross-sectional view of a chip electronic component taken in an LT direction, according to another exemplary embodiment of the present disclosure.
Figure 5:
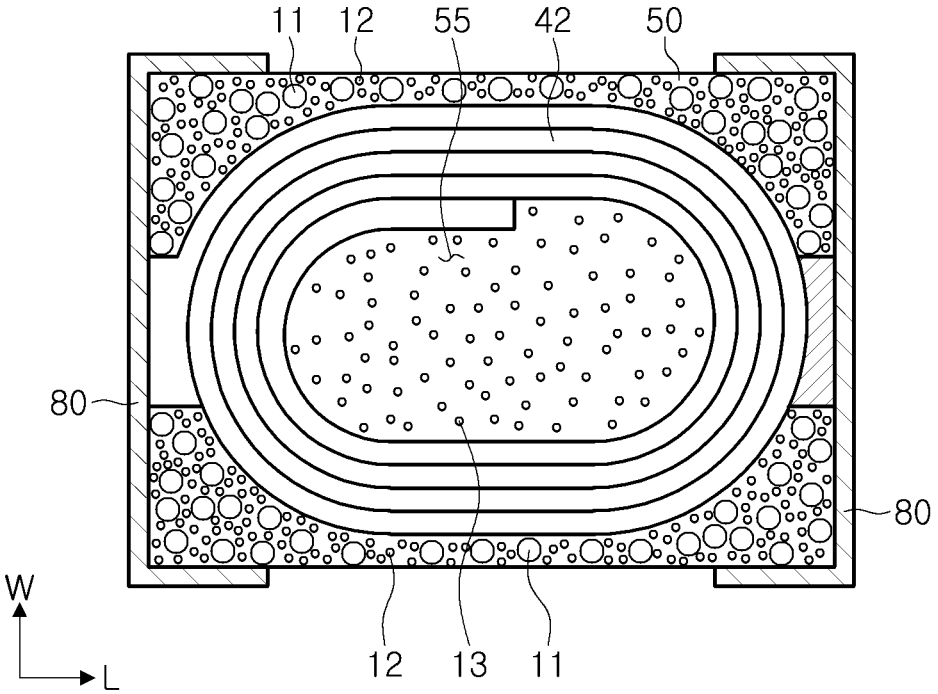
FIG. 5 is a cross-sectional view of the chip electronic component of FIG. 4 taken in an LW direction according to another exemplary embodiment of the present disclosure.

FIG. 4 is a cross-sectional view of a chip electronic component taken in an LT direction, according to another exemplary embodiment of the present disclosure; and FIG. 5 is a cross-sectional view of the chip electronic component of FIG. 4 taken in an LW direction, according to another exemplary embodiment of the present disclosure.

Referring to FIGS. 4 and 5, the central portion 51 having relatively high magnetic permeability may contain first magnetic metal powder particles 11, which are coarse powder particles, and the outer peripheral portion 52 having a relatively low magnetic permeability may contain third magnetic metal particles 13, which are fine powder particles.

The first magnetic metal particles 11 having a large average particle size may have high magnetic permeability. Meanwhile, since the third magnetic metal particles 13, which are the fine powder particles, show low magnetic permeability, but low loss, they may serve to complement core loss increased due to the use of high magnetic permeability materials in the central portion 51.

When the magnetic metal particles, which are the coarse powder particles, and the magnetic metal particles, which are the fine powder particles, are mixed with each other in the central portion 51, a packing factor maybe improved to achieve higher magnetic permeability. However, the present inventive concept is not limited thereto. That is, according to another exemplary embodiment of the present disclosure, the central portion 51 may contain only the first magnetic metal particles 11, which are the coarse powder particles, as shown in FIGS. 4 and 5.

Figure 6:
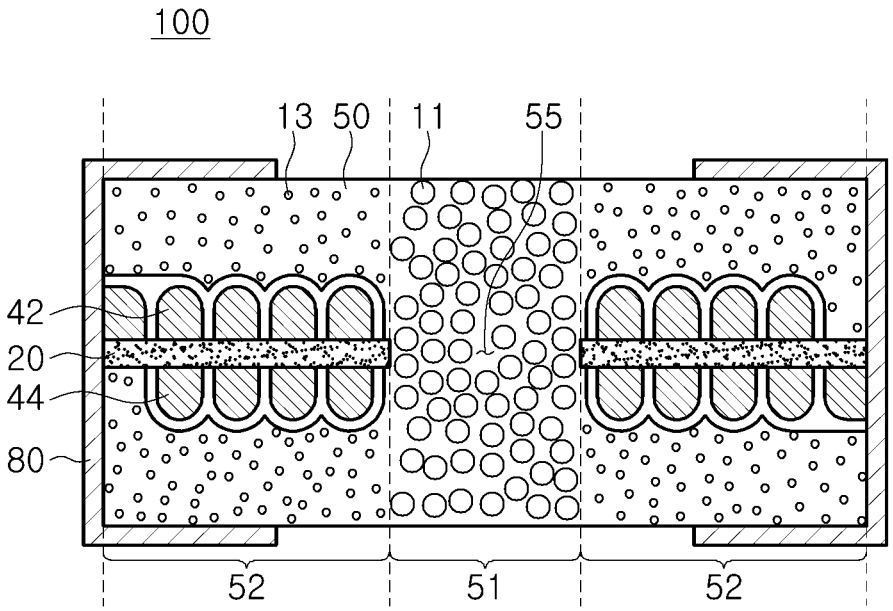
FIG. 6 is a cross-sectional view of a chip electronic component taken in an LT direction according to another exemplary embodiment of the present disclosure.
Figure 7:
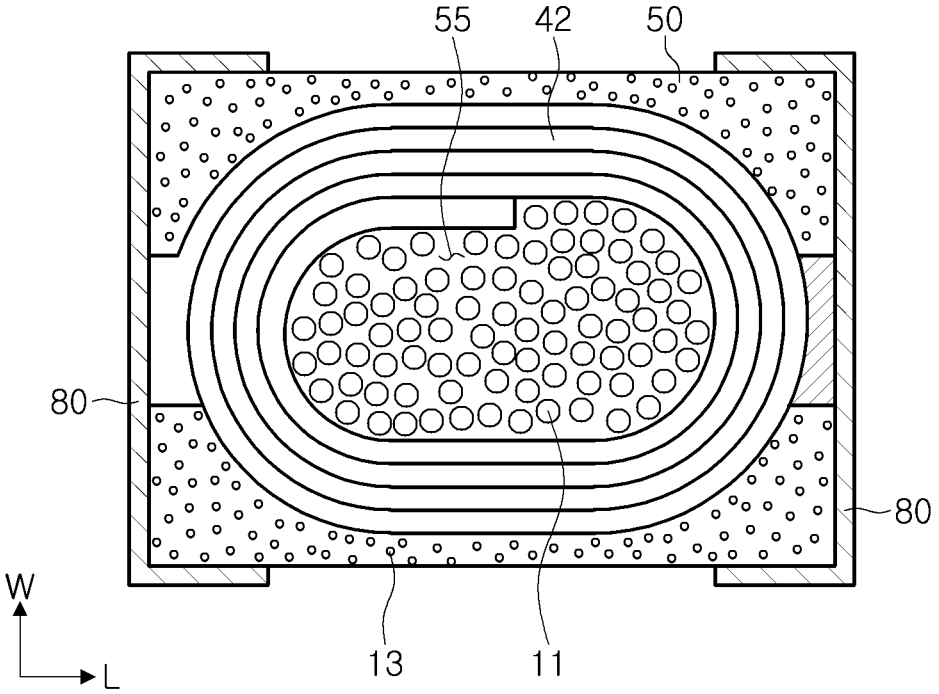
FIG. 7 is a cross-sectional view of the chip electronic component of FIG. 6 taken in an LW direction according to an exemplary embodiment of the present disclosure.

FIG. 6 is a cross-sectional view of a chip electronic component taken in an LT direction, according to another exemplary embodiment of the present disclosure; and FIG. 7 is a cross-sectional view of the chip electronic component of FIG. 6 taken in an LW direction, according to an exemplary embodiment of the present disclosure.

According to another exemplary embodiment of the present disclosure, a magnetic permeability of the first magnetic part maybe lower than that of the second magnetic part, and the first magnetic part may be provided in the central portion 51 and the second magnetic part may be provided in the outer peripheral portion 52, such that a magnetic permeability of the central portion 51 may be lower than that of the outer peripheral portion 52.

Referring to FIGS. 6 and 7, the central portion 51 having a relatively low magnetic permeability may include third magnetic metal particles 13, which are fine powder particles, and the outer peripheral portion 52 having relatively high magnetic permeability may contain mixtures of first magnetic metal particles 11, which are coarse powder particles, and second magnetic metal particles 12, which are fine powder particles, having an average particle size smaller than that of the first magnetic metal particles 11.

The first magnetic metal particles 11 having a large average particle size may have high magnetic permeability, and the first magnetic metal particles 11, which are the coarse powder particles, and the second magnetic metal particles 12, which are the fine powder particles, may be mixed with each other to improve packing factors, thereby further improving a magnetic permeability and improving a Q factor.

Since the third magnetic metal particles 13, which are the fine powder particles, show low magnetic permeability, but low loss, they may serve to complement core loss increased due to use of high magnetic permeability materials, which are coarse powder particles.

A particle size of the third magnetic metal particles 13, which are the fine powder particles, in the central portion 51 may be 0.5 μm to 6 μm.

A packing factor of the magnetic metal particles in the central portion 51 may be 55 to 70%.

A magnetic permeability of the central portion 51 may be 10 H/m to 30 H/m.

A particle size of the first magnetic metal particles 11, which are the coarse powder particles, in the outer peripheral portion 52 may be 11 μm to 53 μm, and a particle size of the second magnetic metal particles 12, which are the fine powder particles, in the outer peripheral portion 52 may be 0.5 μm to 6 μm.

A packing factor of the magnetic metal particles in the outer peripheral portion 52 may be 70 to 85%.

A magnetic permeability of the outer peripheral portion 52 may be 28 H/m to 45 H/m.

As set forth above, according to exemplary embodiments of the present disclosure, high inductance may be secured, and an excellent Q factor may be achieved.

While exemplary embodiments have been shown and described above, it will be apparent to those skilled in the art that modifications and variations could be made without departing from the scope of the present invention as defined by the appended claims.

What is claimed is:

1. A chip electronic component comprising:

a magnetic body having an internal coil part embedded therein, wherein the magnetic body includes:

a central portion provided inside of the internal coil part and including a core; and an outer peripheral portion provided outside of the central portion, wherein a magnetic permeability of the central portion is lower than that of the outer peripheral portion, and wherein the outer peripheral portion contains a mixture of first magnetic metal particles and second magnetic metal particles having an average particle size smaller than that of the first magnetic metal particles, and the central portion contains the third magnetic metal particles having an average particle size substantially similar to the second magnetic metal particles.

2. The chip electronic component of claim 1, wherein a difference between the magnetic permeabilities of the central portion and the outer peripheral portion is 10 H/m to 40 H/m.

3. The chip electronic component of claim 1, wherein the central portion has a magnetic permeability of 10 H/m to 30 H/m, and the outer peripheral portion has a magnetic permeability of 28 H/m to 45 H/m.

4. The chip electronic component of claim 1, wherein the magnetic body contains magnetic metal particles, and a packing factor of magnetic metal particles in the central portion is different from that of magnetic metal particles in the outer peripheral portion.

5. The chip electronic component of claim 1, wherein the first magnetic metal particles have a particle size of 11 μm to 53 μm and the second magnetic metal particles have a particle size of 0.5 μm to 6 μm.

6. The chip electronic component of claim 1, wherein a packing factor of the magnetic metal particles in the central portion is 55% to 70%, and a packing factor of the magnetic metal particles in the outer peripheral portion is 70% to 85%.

7. A chip electronic component comprising:

a magnetic body containing magnetic metal particles; and an internal coil part disposed in the magnetic body, wherein the magnetic body includes a central portion provided inside of the internal coil part and including a core, and an outer peripheral portion provided outside of the central portion, the central portion is provided with a first magnetic part, and the outer peripheral portion is provided with a second magnetic part, wherein a packing factor of magnetic metal particles in the first magnetic part is smaller than that of magnetic metal particles in the second magnetic part, and wherein the outer peripheral portion contains a mixture of first magnetic metal particles and second magnetic metal particles having an average particle size smaller than that of the first magnetic metal particles, and the central portion contains the third magnetic metal particles having an average particle size substantially similar to the second magnetic metal particles.

8. The chip electronic component of claim 7, wherein a magnetic permeability of the first magnetic part is lower than that of the second magnetic part.

9. The chip electronic component of claim 7, wherein a difference between the magnetic permeabilities of the first and second magnetic parts is 10 H/m to 40 H/m.

10. The chip electronic component of claim 7, wherein the packing factor of the magnetic metal particles in the first magnetic part is 55% to 70%, and the packing factor of the magnetic metal particles in the second magnetic part is 70% to 85%.

* * * * *